United States Patent [19]

Gladman et al.

[11] 4,407,680

[45] Oct. 4, 1983

[54] DUAL-PHASE STEELS

[75] Inventors: Terence Gladman, Swinton; Nicholas K. Ballinger, Doncaster, both of England

[73] Assignee: British Steel Corporation, London, England

[21] Appl. No.: 361,852

[22] Filed: Mar. 25, 1982

Related U.S. Application Data

[63] Continuation of Ser. No. 225,667, Jan. 16, 1981, abandoned.

[30] Foreign Application Priority Data

Jan. 18, 1980 [GB] United Kingdom ..... 8001702

[51] Int. Cl.[3] ..... C21D 8/02

[52] U.S. Cl. ..... 148/12 F; 148/12.3; 148/12.4; 148/134; 148/144

[58] Field of Search ..... 148/12 F, 12.1, 12.3, 148/12.4, 134, 144

[56] References Cited

U.S. PATENT DOCUMENTS

| | | | |
|---|---|---|---|
| 3,337,376 | 8/1967 | Grange | 148/134 |
| 3,726,723 | 4/1973 | Coldren et al. | 148/12.3 |
| 3,904,446 | 9/1975 | Uchida et al. | 148/12.3 |
| 4,023,988 | 5/1977 | Stickels et al. | 148/12.4 |
| 4,062,700 | 12/1977 | Hayami et al. | 148/134 |
| 4,113,513 | 9/1978 | Uchida et al. | 148/12.3 |
| 4,159,218 | 6/1979 | Chatfield et al. | 148/12.4 |
| 4,188,241 | 2/1980 | Watanabe et al. | 148/12 C |
| 4,196,025 | 4/1980 | Davies | 148/36 |
| 4,285,741 | 8/1981 | Furukawa et al. | 148/36 |

FOREIGN PATENT DOCUMENTS

| | | | |
|---|---|---|---|
| 50-14215 | 5/1975 | Japan | 148/12.3 |
| 54-114425 | 9/1979 | Japan | 148/12 F |
| 54-114426 | 9/1979 | Japan | 148/12 F |
| 54-155920 | 12/1979 | Japan | 148/12 F |

*Primary Examiner*—Peter K. Skiff

*Attorney, Agent, or Firm*—Bacon & Thomas

[57] ABSTRACT

A process for producing a dual-phase steel in which strip is hot-rolled and cooled to exhibit a substantially bainite structure throughout its cross-section and in which it is subsequently continuously annealed in the two phase ferrite/austenite field and cooled to transform the austenite to martensite. By inter-critically annealing a bainite as opposed to a ferrite/pearlite starting structure in accordance with this invention a very much finer and more uniform distribution of martensite is obtained—this gives rise to superior combinations of ductility and tensile strength.

5 Claims, 5 Drawing Figures

(a) Bainite starting structure (V-steel)

(b) Typical dual-phase structure resulting from (a)

(c) Bainite starting structure (Mo-Cr steel)

(d) Typical dual-phase structure resulting from (c)

(e) A typical ferrite-pearlite starting structure (f) A typical conventional dual-phase structure resulting from (e)

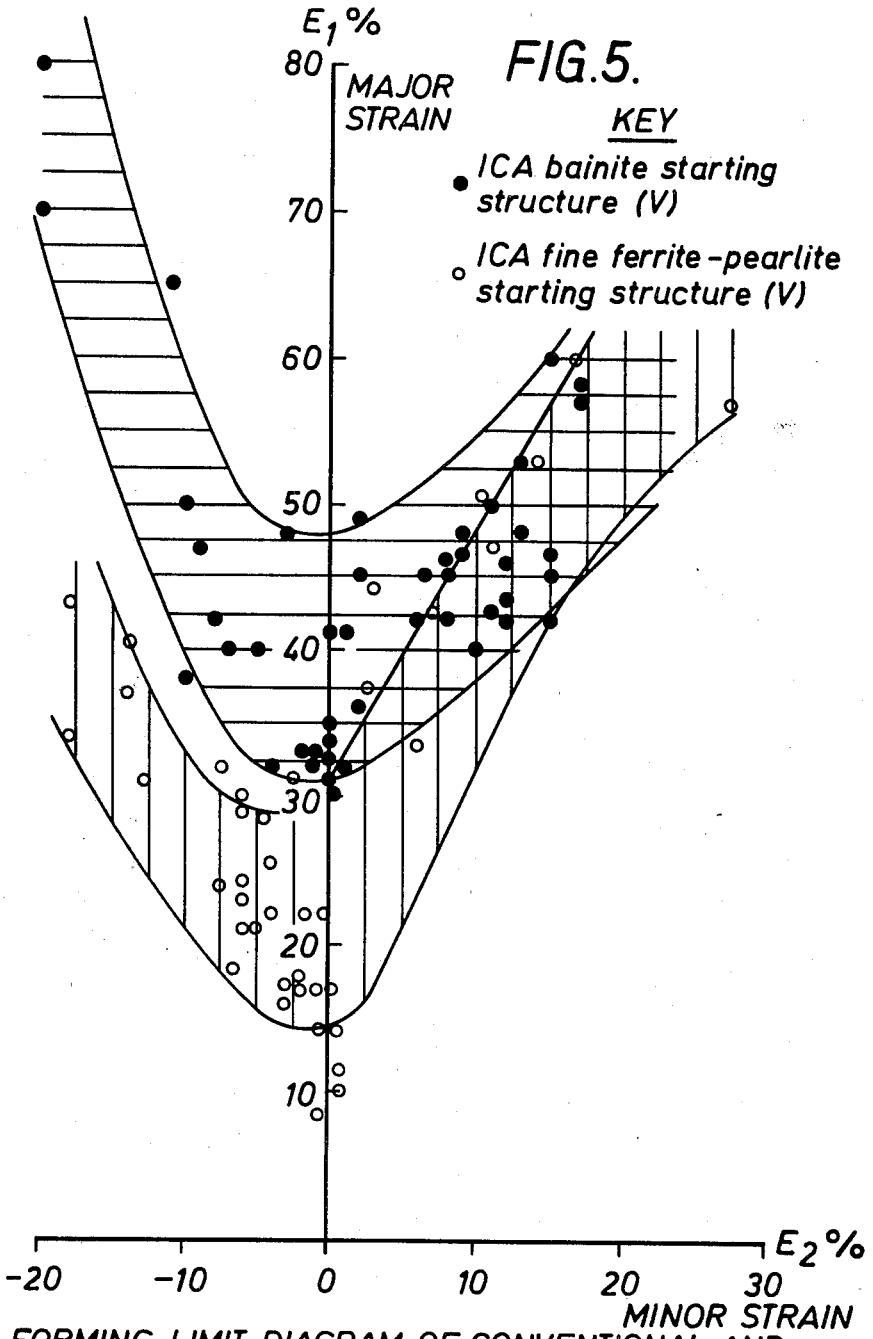
FORMING LIMIT DIAGRAM OF CONVENTIONAL AND ULTRAFINE DUAL-PHASE STEELS

DUAL-PHASE STEELS

This application is a continuation of application Ser. No. 225,667, filed Jan. 16, 1981 and now abandoned.

This invention relates to the production of strip steel, and, in particular, relates to the production of dual-phase strip steel, that is, steel comprising a predominantly ferrite matrix interspersed with discrete particles of martensite or martensite-austenite constituent.

The development of dual-phase steels is a move toward the optimisation of the properties of strength and ductility—which are generally inversely related to one another—such that for a given tensile strength level the steel exhibits a greater ductility than hitherto, e.g., greater than ferrite-pearlite high-strength low alloy steels, and it is an object of this invention to produce a further improvement in ductility with strength.

From one aspect the present invention provides a process for producing a dual-phase steel in which hot-rolled strip is cooled to exhibit a substantially uniform bainitic structure throughout its cross-section as it issues from the mill and in which the strip is subsequently continuously annealed in the two-phase ferrite/austenite field and cooled to transform some, or all, of the austenite to martensite.

This latter step is conventionally referred to as inter-critically annealing, and we have found that intercritically annealing substantially a bainitic, as opposed to a ferrite-pearlite, starting structure leads to a very much finer and more uniform distribution of martensite. For example, mean martensite island diameters resulting from a bainite starting structure are typically 1–3 μm compared with, say, 3–10 μm resulting from ferrite-pearlite starting structures, ie conventional dual-phase material. For this reason, dual-phase material obtained from a bainite starting structure in accordance with this invention can thus be termed 'ultra-fine' and gives rise to superior combinations of ductility (measured as total elongation) and tensile strength. The increased ductility is due to an increased work hardening rate, which increases the strain to the onset of necking and retards the localisation of strain during necking, and to an increased resistance to fracture, which is reflected in increased true fracture strains.

The improved properties are not critically dependent upon the composition of the steel, provided that the desired microstructure can be developed. Steels—containing preferably less than 2% Mn to maintain an adequate level of weldability—should have sufficient alloy additions to produce a bainitic structure in the hot rolled strip and to produce an adequate amount of martensite after inter-critical annealing.

In order that the invention may be fully understood, examples will now be given of three steels treated in accordance with this invention with reference to the accompanying drawings, in which:

FIGS. 1(*a*) to 1(*f*) show a series of micrographs of various steel structures, and illustrate that refinement of the martensite particles in the dual-phase steels is attained by using a bainitic starting structure;

FIG. 5 is a graphical illustration of forming limits for the FIG. 4 steels.

Figure 1:
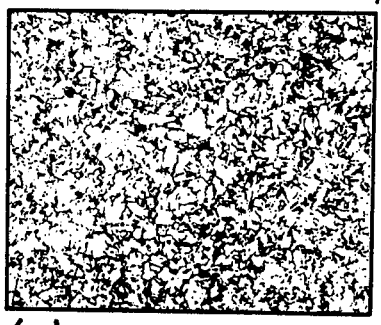
Figure 1:
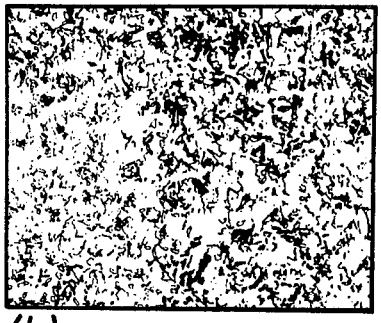
Figure 1:
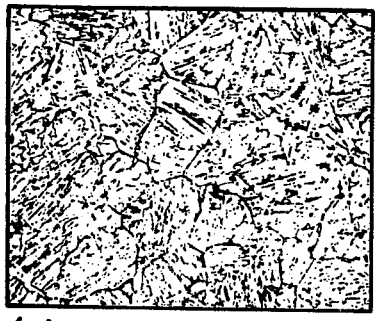
Figure 1:
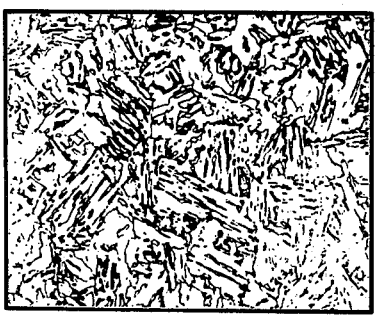
Figure 1:
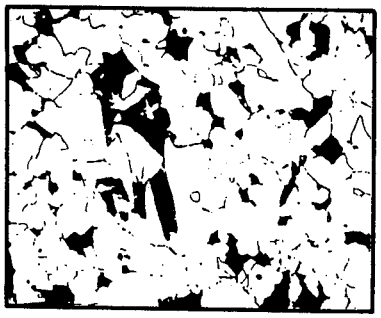
Figure 1:
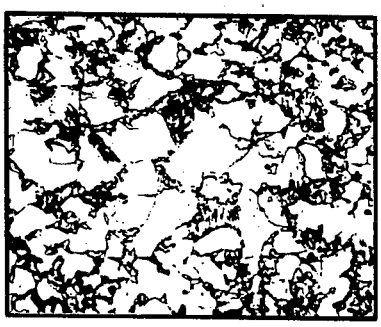

Referring now to FIG. 1, (*a*) shows a micrograph of a vanadium strip steel exhibiting the requisite bainitic starting structure as required in accordance with this invention. The composition of the steel, in weight percent, is as follows:

| C | Mn | Si | Cr | Mo | V | N | P | S |
|---|---|---|---|---|---|---|---|---|
| 0.12 | 1.44 | 0.49 | 0.06 | <0.04 | 0.07 | 0.011 | 0.008 | 0.007 |

Various specimens of this trip material, 3.4 mm in thickness, were annealed in a conventional furnace at temperatures ranging from 730° C. to 850° C., that is, in the two-phase ferrite/austenite field, for times of between five and thirty minutes. The anneal was terminated by a water or oil quench or simply by air-cooling.

A micrograph of a typical dual-phase structure resulting from this treatment is depicted in FIG. 1(*b*).

FIG. 1(*c*) shows a micrograph of a molybdenum-chromium steel with the requisite bainitic starting structure: the composition of this steel is as follows:

| C | Mn | Si | Cr | Mo | Al | N | P | S |
|---|---|---|---|---|---|---|---|---|
| 0.12 | 1.24 | 0.88 | 0.60 | 0.43 | 0.029 | 0.008 | 0.014 | 0.025 |

As before, this material was inter-critically annealed and cooled to transform the austenite to martensite, the resulting dual-phase structure being illustrated in FIG. 1(*d*).

Another strip steel (2 mm in thickness) treated in this fashion, from which a comparable dual-phase structure was obtained, was a plain carbon-manganese steel having the following composition:

| C | Mn | Si | Cr | Mo | Al | N | P | S |
|---|---|---|---|---|---|---|---|---|
| 0.13 | 1.88 | 1.68 | <0.02 | <0.02 | 0.058 | 0.014 | 0.012 | 0.024 |

All three steels treated exhibited an ultra-fine dual-phase structure with exceptionally small mean martensite island diameters of between 1 and 3 μm.

A direct comparison of the finer and more uniform structure with that produced from a more conventional ferrite-pearlite starting structure (FIG. 1(*e*)) can be made by referring to FIGS. 1(*b*), (*d*) and (*f*), the former pair showing the fine dual-phase structure and the latter the comparatively coarse structure deriving from ferrite pearlite. The mean martensite island diameters of the latter are spread between 3 and 10 μm, and, indeed, with a coarse ferrite-pearlite starting structure even coarser martensite islands are obtained, eg, of the order of 6 to 12 μm.

Figure 2:
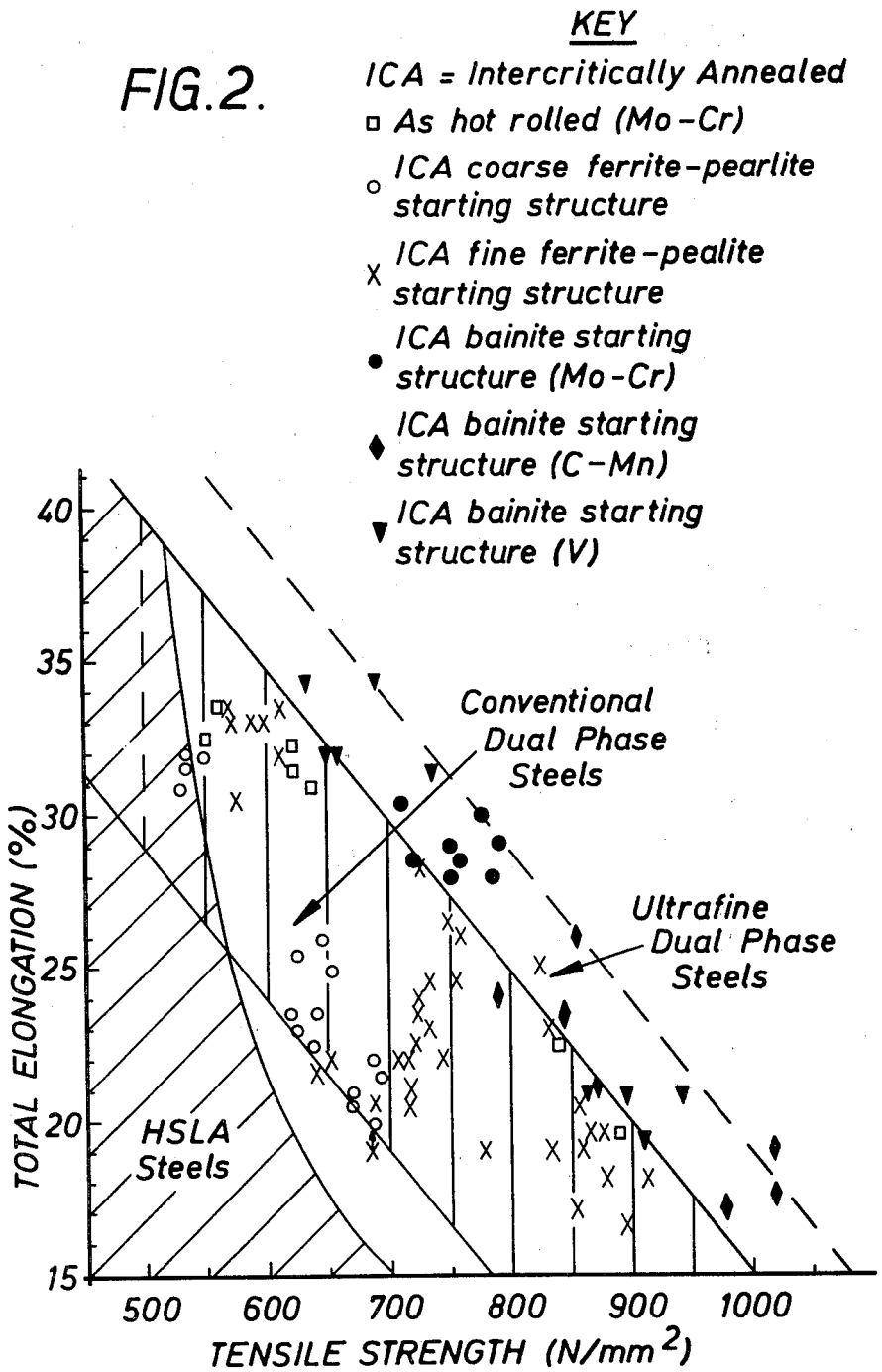
FIG. 2 is a graphical illustration of tensile strength v. total elongation(%)—ie, ductility—for conventional HSLA steels, conventiona dual-phase steels and the ultra-fine dual-phase material of this invention (V, C-Mn and Mo-Cr) made on a laboratory scale from which the benefits of this invention can be readily appreciated.
Figure 3:
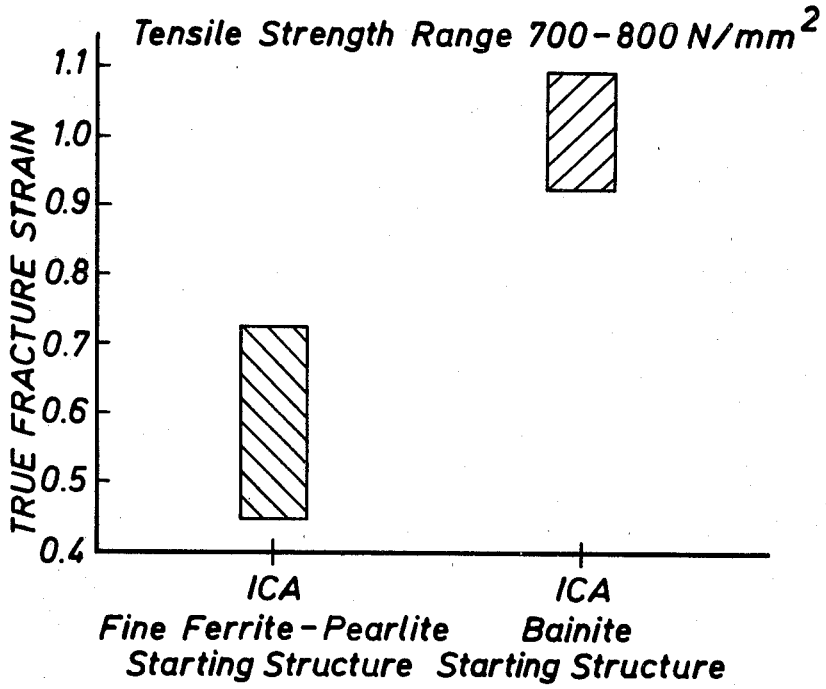
FIG. 3 is a plot by which the true fracture strains for conventional and our ultra-fine dual-phase materials may be compared.

The main effect of this structural refinement in dual-phase steels is to increase the total elongation at a given strength level. This is apparent from FIG. 2 where the characteristics of various examples of the three steels mentioned are plotted along with conventional dual-phase steels produced from both fine and coarse ferrite-pearlite starting structures—a typical range for high-strength low alloy steels is also shown. The true fracture strain is also improved—FIG. 3.

Figure 4:
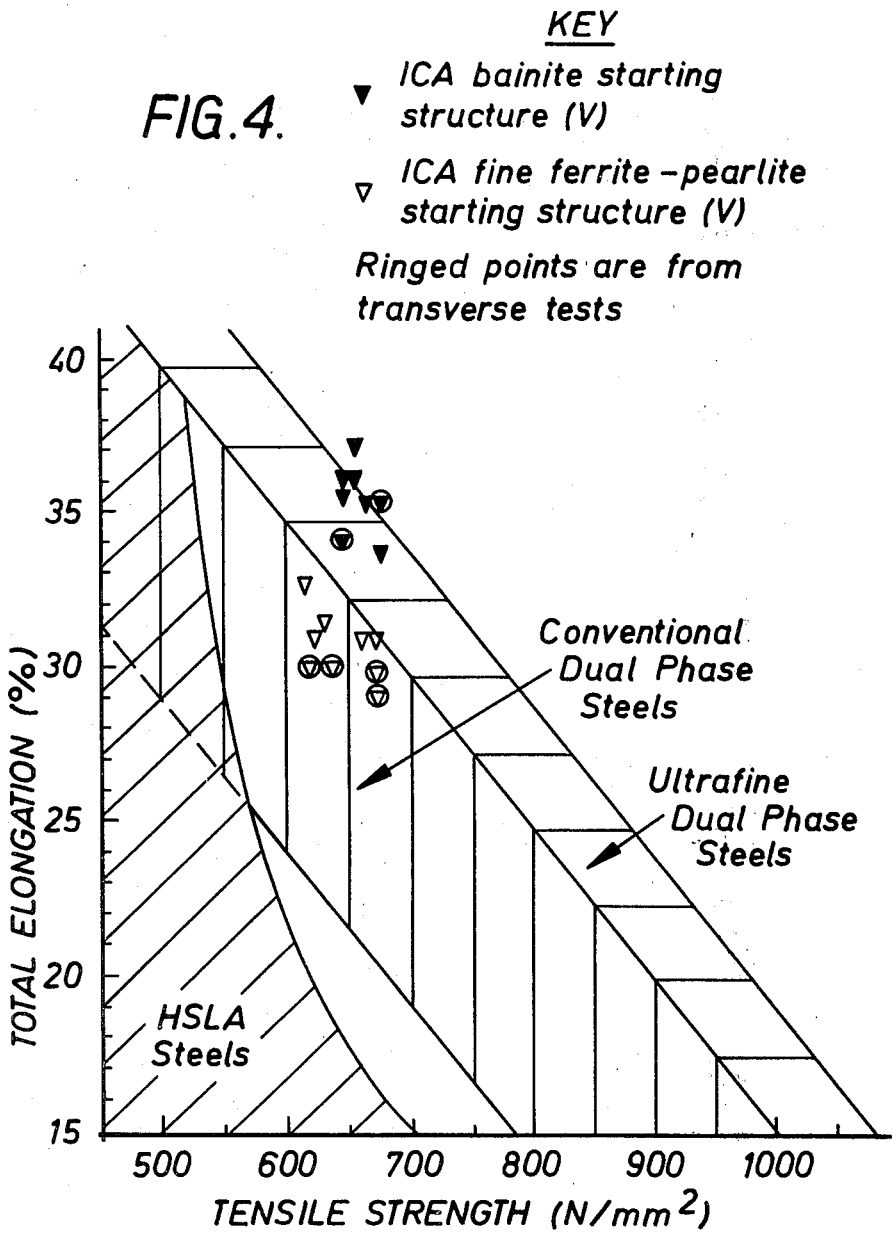
FIG. 4 is a graphical illustration of tensile strength v. total elongation (%) for another set of results for the conventional dual phase material and for ultrafine dual-phase vanadium steels derived from coils processed on a commercial mill.

Formability assessments have been made on two commercially produced coils having the same composition as the vanadium specimens cited in the first example, one having conventional and the other ultra-fine dual-phase structures. The tensile properties are shown in FIG. 4 and confirm the beneficial effects of the finer and more uniform structure of the ultra-fine dual-phase material. The forming limit diagrams of these conventional and ultra-fine materials having a gauge of 3.4 mm, are shown in FIG. 5, these being determined by Nakajima et al described in Section 3.2 in Yawata Technical Report No. 264, September 1968. The superiority of the ultra-fine dual-phase structure over the conventional material is clearly shown in the higher limit strains.

In order to understand the reasons for the superior properties of the ultrafine dual-phase steels, both the work-hardening and the fracture characteristics must be considered. Increasing the work-hardening rate, increases both the uniform strain and reduces the strain concentration during the necking process, this increases the overall elongation even when there is no increase in true fracture strain. It has been found by us that the work-hardening rate is directly proportional to the parameter $\sqrt{f/d}$, where f is the volume fraction of marteniste and d is the mean martensite island diameter.

A further consequence of the refinement of the martensite island size and distribution is an increased resistance to cracking of the martensite islands. As the size of the islands is reduced, the spacing between them is correspondingly reduced (for a given volume fraction). This reduces the effective stress on the martensite islands and retards the formation of cracks in the martensite, the latter being the initiation sites for ductile fracture.

The significance of this invention is quite clear: ultra-fine dual-phase steels show combinations of strength and ductility, and greater resistance to cracking problems than are shown by conventional dual-phase steels. The increased work-hardening rates will also give improved strain distribution in pressings.

We claim:

1. A process for producing a hot-rolled dual-phase low carbon steel in which steel strip is hot-rolled in a mill, cooled to exhibit a substantially uniform bainitic structure throughout its cross-section as it issues from the mill and in which the strip is subsequently transported through an annealing furnace and continuously annealed in the two-phase ferrite austenite field and cooled to transform some, or all, of the austenite to martensite.

2. A process according to claim 1, in which the strip is annealed at temperatures between 730° C. and 850° C., the anneal being terminated by a fluid quench, the fluid being water or oil.

3. A process according to claim 2, in which the strip steel composition includes manganese at a level not exceeding 2%.

4. A process according to claim 3, in which the strip steel includes vanadium as an alloying element.

5. A process according to claim 4, in which the strip steel includes chromium and molybdenum as alloying elements.

* * * * *